US008210816B2

(12) United States Patent
Geldenhuys

(10) Patent No.: US 8,210,816 B2
(45) Date of Patent: Jul. 3, 2012

(54) IMPELLER FOR A CENTRIFUGAL PUMP

(75) Inventor: Siegfried Geldenhuys, Pretoria (ZA)

(73) Assignee: Weir Minerals Africa (Proprietary) Limited, Isando (ZA)

( * ) Notice: Subject to any disclaimer, the term of this patent is extended or adjusted under 35 U.S.C. 154(b) by 971 days.

(21) Appl. No.: 11/908,937

(22) PCT Filed: Mar. 10, 2006

(86) PCT No.: PCT/IB2006/050894

§ 371 (c)(1),
(2), (4) Date: May 20, 2008

(87) PCT Pub. No.: WO2006/097908

PCT Pub. Date: Sep. 21, 2006

(65) Prior Publication Data

US 2009/0226317 A1 Sep. 10, 2009

(30) Foreign Application Priority Data

Mar. 16, 2005 (ZA) ..... 2004/07454

(51) Int. Cl.
*F04D 29/24* (2006.01)

(52) U.S. Cl. ..... 416/182; 416/183; 416/186 R

(58) Field of Classification Search ..... 416/182, 416/183, 186 R, 187, 209
See application file for complete search history.

(56) References Cited

U.S. PATENT DOCUMENTS 2,207,317 A * 7/1940 Gear ..... 415/97
3,246,605 A 4/1966 Fisher
3,535,051 A * 10/1970 Turner ..... 415/196
3,953,150 A * 4/1976 Onal ..... 416/184
4,527,947 A * 7/1985 Elliott ..... 415/225
4,613,281 A 9/1986 Lubieniecki
4,664,592 A 5/1987 Grzina et al.
4,854,820 A * 8/1989 Zolotar et al. ..... 416/186 R
4,940,385 A 7/1990 Gurth et al.
5,209,635 A * 5/1993 Stewart et al. ..... 415/171.1
5,489,187 A * 2/1996 Ray ..... 415/111

(Continued)

FOREIGN PATENT DOCUMENTS

DE 2344576 A1 3/1975

(Continued)

OTHER PUBLICATIONS

"Warman AHU Heavy Duty Slurry Pumps" by Warman International, print reference WA-29008 (4 pages).

(Continued)

*Primary Examiner* — Igor Kershteyn
(74) *Attorney, Agent, or Firm* — The Culbertson Group, P.C.

(57) ABSTRACT

A centrifugal pump (10) includes a pump casing (12) within which an impeller (14) is mounted for rotation, cantilever fashion, on a shaft (16). The casing (12) has an axial inlet (20), and a peripheral volute (22) around the impeller (14) leading to an outlet (24). The impeller (14) has axially spaced annular sides (26, 28) with radially outwardly arranged, rearwardly curved, vanes (30) between the sides. Outwardly of the sides, clearing corresponding sides of the casing (12), auxiliary vanes (32, 34) are provided to generate a pressure gradient to prevent or counteract leakage of working fluid. Leading faces of the auxiliary vanes slope relative to a perpendicular to the sides, i.e. the leading edges are at an obtuse angle to the sides (26, 28).

6 Claims, 4 Drawing Sheets

U.S. PATENT DOCUMENTS

| | | | | |
|---|---|---|---|---|
| 6,951,445 | B2 * | 10/2005 | Burgess | 416/198 R |
| 7,500,830 | B2 * | 3/2009 | Graham et al. | 416/186 R |
| 2004/0156717 | A1 | 8/2004 | Larsson | |

FOREIGN PATENT DOCUMENTS

| | | | |
|---|---|---|---|
| DE | 88 11 026 | U1 | 10/1988 |
| WO | WO 2004/111463 | A1 | 12/2004 |

OTHER PUBLICATIONS

WEIR company presentation "Acquisition of CH Warman" especially company history on p. 4 (9 pages).
Type Series Booklet KWP, No. 2361.5/6-10 G3, printed Mar. 2, 1998 (16 pages).
Order confirmation No. 9042200191 dated Sep. 4, 2001 especially pp. 1, 2, and 6 with item 007 (13 pages).
Invoice No. 2.495.007 dated Feb. 28 and Mar. 5, 2001 especially pp. 1 and 2 with item 007 (in respect of Order confirmation No. 9042200191) (6 pages).
Archived parts list No. 297615 dated Feb. 22, 2001 especially pp. 1 and 4 (in respect of Order confirmation No. 9042200191) (12 pages).
Drawing No. ZO40532-12, Impeller geometry KWPK 125-503 (1 page).
DIN EN 12890, edition Jun. 2000 (23 pages).
KSB Aktiengesellschaft's Letter from the Opponent filed Sep. 3, 2010, in European Patent No. 1 859 172 B1 (9 pages).
KSB Aktiengesellschaft's Notice of Opposition (specifically arguments against patentability) filed Jul. 8, 2009, in European Patent No. 1 859 172 B1 (9 pages).

* cited by examiner

OBTUSE - OBTUSE

PERPENDICULAR - OBTUSE

OBTUSE - PERPENDICULAR

PERPENDICULAR

SMOOTH

IMPELLER FOR A CENTRIFUGAL PUMP

THIS invention relates to an impeller for a centrifugal pump, and to a centrifugal pump.

The invention relates more specifically to an impeller having axially spaced, annular sides; circumferentially spaced vanes, each extending between the sides; and circumferentially spaced auxiliary vanes outwardly of one or both sides. In use, the auxiliary vanes rotate with running clearance with the impeller in an annular space between the or each side and a corresponding side of a stationary pump casing, thus potentially creating a head to prevent or at least counter any leakage or recirculation from an outer high pressure peripheral outlet of the impeller radially inwardly in-between the impeller and the casing.

The Applicant believes that this invention will find particular application in pumps pumping abrasive fluids, especially slurry pumps, and such an application will particularly be borne in mind for purposes of the specification. The invention is, however, not limited to such an application.

In accordance with the invention, broadly, there is provided an impeller for a centrifugal pump generally of the kind described, in which impeller leading faces of the auxiliary vanes are slanted relative to the perpendicular to the respective impeller side.

Thus, the leading faces may be at an obtuse angle to the respective impeller side. This can be visualized that, at any radial position, an axially outer point on any auxiliary vane trails a relatively axially inner point in use.

The (obtuse) angle between a leading face of an auxiliary vane and the impeller side may be between about 100° and about 170°, preferably between about 120° and 1500, most preferably by about 135°. The angle may be constant along a length of the respective auxiliary vane.

In one species of embodiments, trailing edges of the auxiliary vanes may be slanted relative to the perpendicular to the respective impeller side, i.e. such that an angle between the trailing face and a side is obtuse.

Instead, in another species of embodiments, trailing edges of the auxiliary vanes may be perpendicular to the respective impeller side.

Generally, it is envisaged that radially outer peripheral faces of the auxiliary vanes will be cylindrical. However, instead, they may be slanted, tapering in an axially outward direction(s) away from the or each side.

The impeller may be of moulded or cast construction. Then, it is to be appreciated, in order to facilitate demoulding, that angles may deviate from nominal values (such as 90°) by a demoulding angle of, say, 1 to 3 degrees.

In accordance with a further aspect of this invention, there is provided a centrifugal pump having an impeller in accordance with the main aspect of the invention.

The invention is now described by way of example with reference to the accompanying diagrammatic drawings. In the drawings FIG. 1 shows, in three-dimensional, partially cut-away, view, a centrifugal pump in accordance with the invention;

Figure 1:
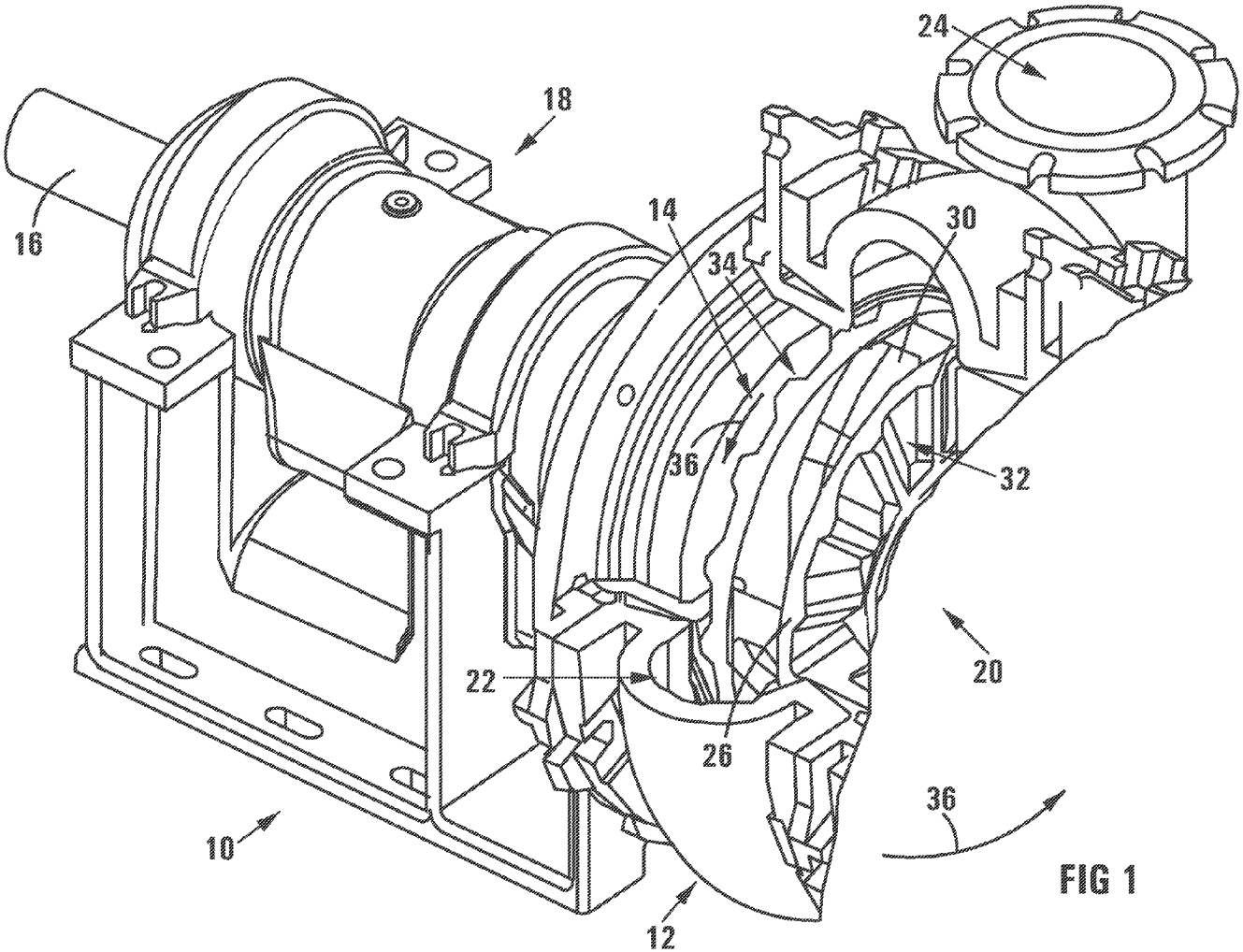

With reference to FIG. 1 of the drawings, a centrifugal pump in accordance with the invention is generally indicated by reference numeral 10. The pump has a pump casing generally indicated by reference numeral 12, within which an impeller 14 is rotatable. The impeller 14 is mounted, cantilever fashion, at an end of a shaft 16 which is rotatably supported in a bearing arrangement generally indicated by reference numeral 18.

The pump casing 12 defines an inlet 20 leading to an inlet of the impeller 14. The pump casing 12 further defines a peripheral volute 22 around the impeller 14 and leading to an outlet 24.

The impeller 14 has an inlet end annular side 26, and an opposed shaft end side 28. Main vanes 30, in the embodiment shown, are conventionally provided in circumferentially spaced generally radially outwardly curved configuration between the sides 26, 28. The direction of rotation of the impeller 14 is shown by arrow 36.

The impeller 14 includes auxiliary vanes 32 outwardly of the inlet end side 26 and auxiliary vanes 34 outwardly of the shaft end side 28.

Figure 2:
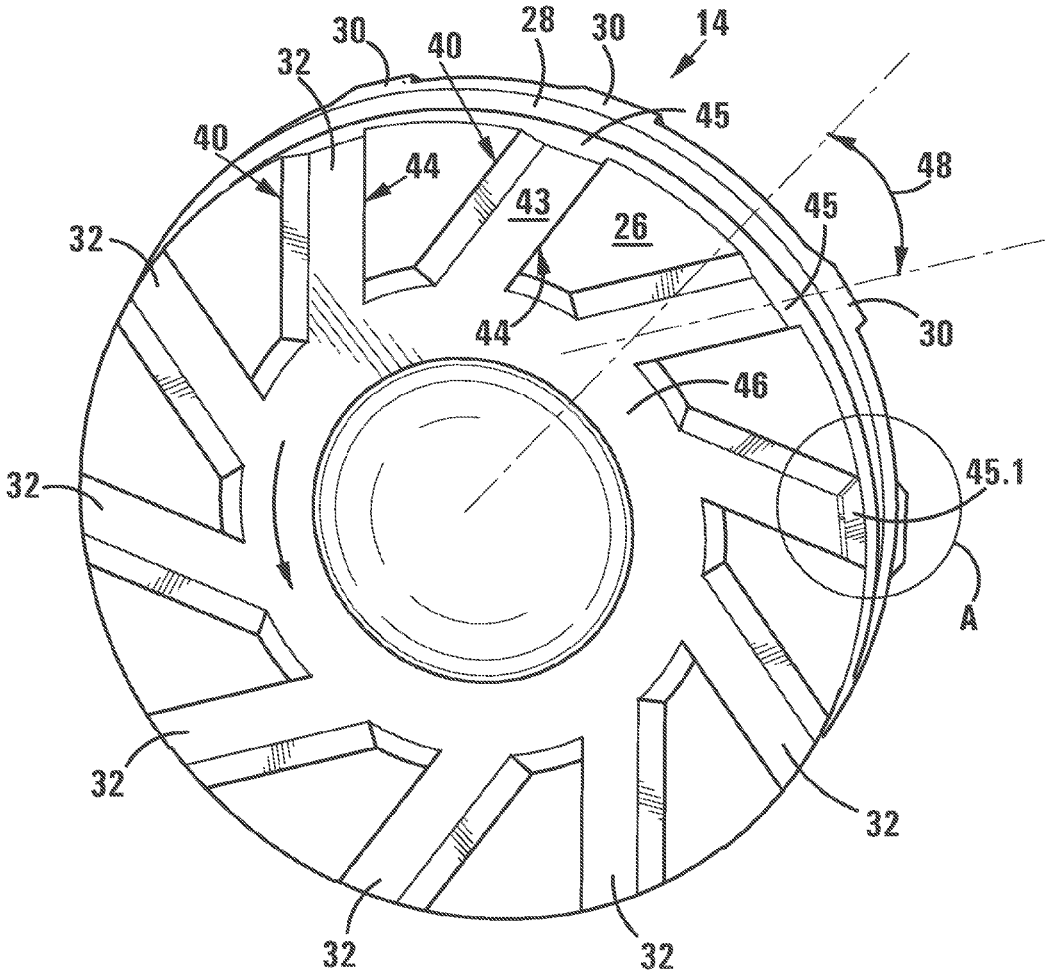
FIG. 2 shows, fragmentarily, in perspective view from an inlet end, an impeller in accordance with the invention.

In accordance with this invention, and with reference also to FIG. 2, leading faces of the auxiliary vanes are indicated by reference numeral 40. In FIG. 2, the auxiliary vanes on the inlet end side 26 only are shown, and the auxiliary vanes 34 are generally mirror images.

Each auxiliary vane 32 has, opposed to the leading face 40, a trailing face 44 and a side 43 which, in use, will pass with little clearance past the stationary casing. Each auxiliary vane 32, relative to a radius, for example as indicated in dotted in FIG. 2, is slanted rearwardly relative to the direction of rotation to form an angle indicated by reference numeral 48.

In accordance with the invention, each leading face 40 is slanted or oblique relative to a hypothetical plane perpendicular to the side 26, such that an obtuse angle between the side 26 and each leading face 40 is formed. The obtuse angle, in this embodiment, is about 135°.

The Applicant has found, especially in pumps having an abrasive working fluid, most especially slurry, that radially outer portions of auxiliary vanes, especially on the inlet side, are abraded away rapidly. Thus, even if a conventional auxiliary vane, having a perpendicular leading face, has high efficiency initially, it loses efficiency very quickly and becomes unacceptably inefficient correspondingly quickly. In this regard, it has to be borne in mind that a head or pressure generated by a vane is a quadratic function of the radial position. Thus, if an outermost portion becomes non-functional, the negative effect on potential head generated is particularly severe.

In contrast, the Applicant has found that auxiliary vanes having oblique leading faces in accordance with the invention do not abrade away as fast as conventional vanes having perpendicular leading faces, and that such auxiliary vanes in accordance with the invention which have slanted leading faces, retain an acceptable efficiency in generating a head to counteract leakage, for a longer period. This, commensurately, extends the operating life of auxiliary vanes before maintenance or replacement is required. As abrasion of the auxiliary vanes, especially at the inlet side, is quite frequently the deciding factor in operating time between overhauls, extending such operating time in accordance with the invention is particularly meritorious.

A further advantage is that preventing, or at least reducing, flow of the abrasive working fluid, generally ameliorates wear.

If desired, the trailing edges 44 of the vanes 32 may, likewise, be slanted, i.e. at an obtuse angle to the respective impeller side. The angle may be the same, or different to i.e. smaller or larger than the angle of the leading face 40.

In another embodiment, the trailing face may be perpendicular to the impeller side.

As can be seen from FIG. 2, the radially outer peripheral faces 45 of the auxiliary vanes 32 are cylindrical and flush with the corresponding periphery of the sides 26, 28. In another embodiment, such faces may slant, i.e. they may taper in an axially outward direction, such that axial extremities of such faces are at a smaller diameter than the respective side. Furthermore, adjoining surfaces may be chamfered or bevelled.

Figure 3:
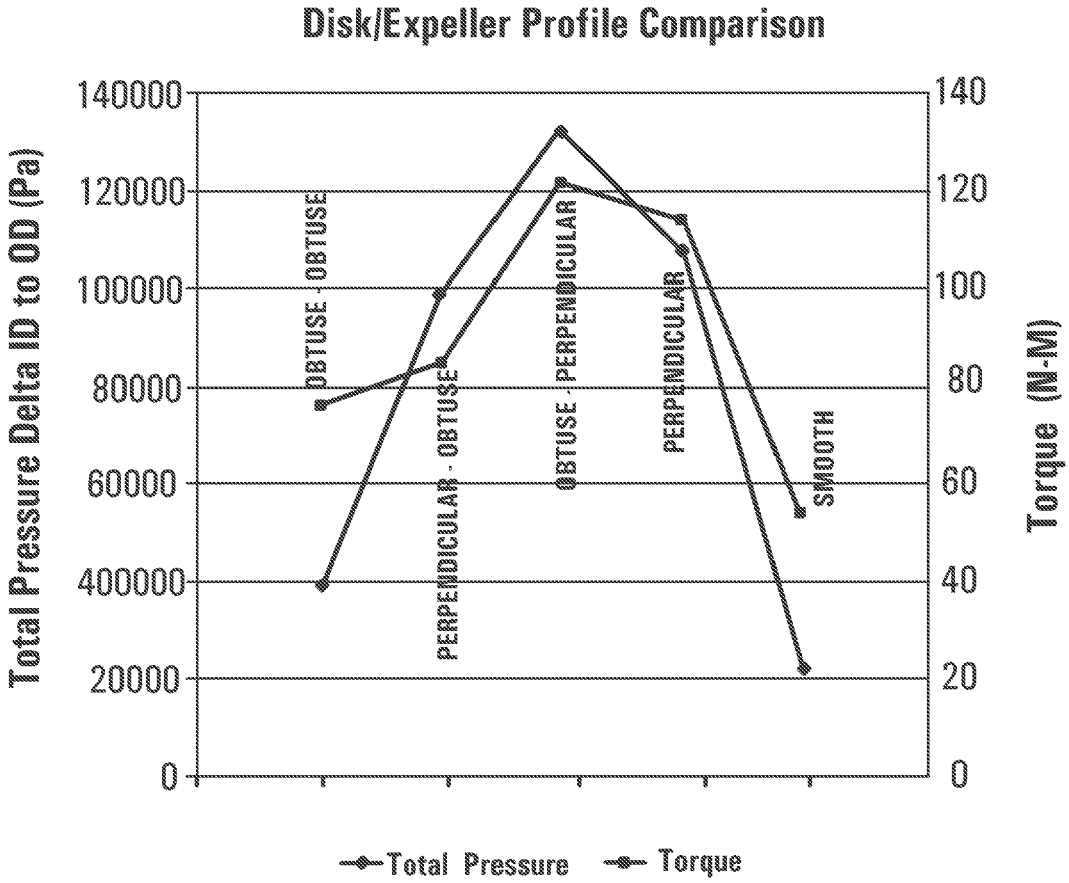
FIG. 3 shows, graphically, a comparison respectively between four different configurations of auxiliary vanes, only two of which are in accordance with the invention, and an impeller having a smooth disc, i.e. without auxiliary vanes.
Figure 4:
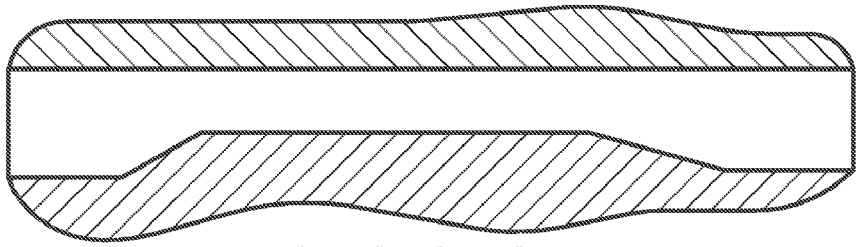
FIG. 4 shows, schematically, in section, the four auxiliary vane profiles and the profile of an impeller without auxiliary vanes.
Figure 4:
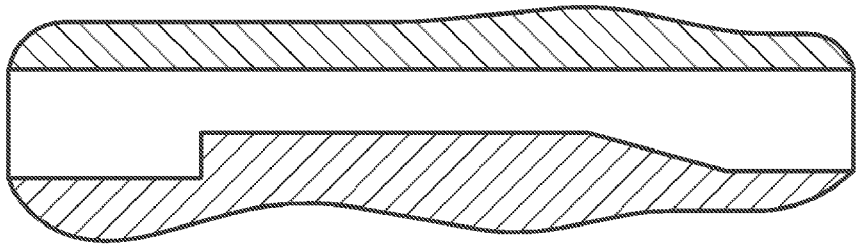
Figure 4:
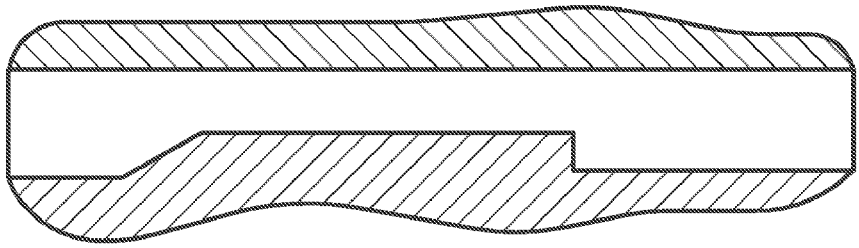
Figure 4:
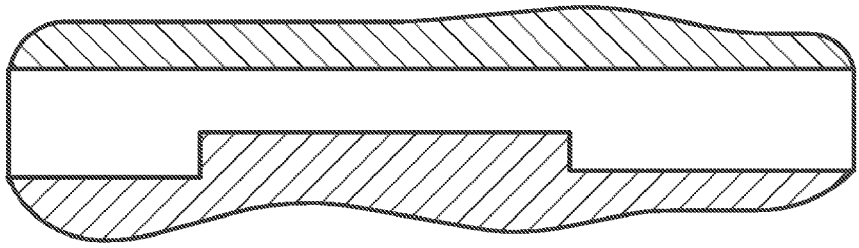
Figure 4:
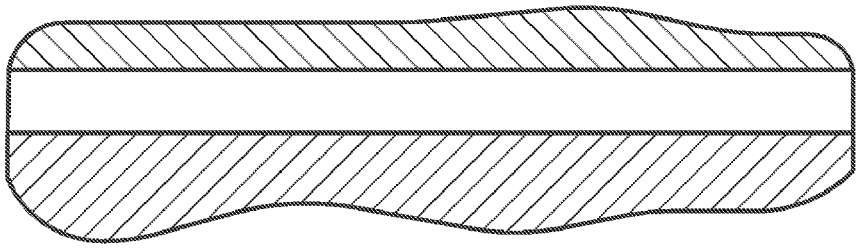

With reference to FIGS. 3 and 4, theoretical results of pressure gradients or pressure differences generated by motion of a vane profile past a flat surface are graphically shown. In FIG. 4, four different profiles are shown in relation to a stationary flat side, i.e. a side such as a side of the casing, past which the profiles move. For comparison purposes, the running clearance between the crest of the vane, and the stationary flat surface is kept constant for all cases. A fifth case represents an impeller side without auxiliary vanes moving past a stationary flat surface, i.e. past the side of the casing.

Also shown on the same graph, is the torque required to move the vane, i.e. gives an indication of the energy requirement to overcome the fluid resistance. Torque for the flat surface (no vane) is also shown.

It is to be appreciated that the results are theoretical, and are appropriate for comparative purposes only.

It is to be appreciated that the theoretical comparison in FIGS. 3 and 4 relate to pressure gradient generated, and torque required to generate the pressure gradient. The results do not relate to the prime consideration in accordance with this invention, namely to ameliorate wear on a leading face of an auxiliary vane. It is believed, and preliminary tests have shown, that wear is ameliorated by the use of auxiliary vanes having slanted leading faces.

The invention claimed:

1. An impeller for a centrifugal pump, the impeller including:

axially spaced, annular sides, one of which is an inlet end side;

circumferentially spaced main vanes, each main vane extending between the annular sides; and circumferentially spaced auxiliary vanes axially outwardly of the inlet end sides, wherein a leading faces of each auxiliary vanes is slanted relative to the perpendicular to the inlet end side at an obtuse angle to the inlet end side of between 100° and 170°, and wherein a radially outer peripheral face of each auxiliary vane is slanted, tapering in an axially outward direction away from the inlet end side such that the axial extremity of the outer peripheral face of each auxiliary vane is at a relatively smaller diameter than the inlet end side.

2. An impeller as claimed in claim 1, wherein the obtuse angle is constant along a length of the respective auxiliary vane.

3. An impeller as claimed in claim 1, any in which a trailing edges of each auxiliary vane is slanted relative to the perpendicular to the inlet end side.

4. An impeller as claimed in claim 1, in which a trailing edges of each auxiliary vanes is perpendicular to the inlet end side.

5. An impeller as claimed in claim 1 which is of moulded or cast construction.

6. A centrifugal pump including:

a pump casing defining an inlet and an outlet;

an impeller shaft; and an impeller mounted within the pump casing on an end of the impeller shaft, the impeller including (i) axially spaced, annular sides, one of which is an inlet end side, (ii) circumferentially spaced main vanes, each main vane extending between the annular sides; and (iii) circumferentially spaced auxiliary vanes axially outwardly of the inlet end side, wherein a leading face of each auxiliary vane is slanted relative to the perpendicular to the inlet end side at an obtuse angle to the inlet end side of between 100° and 170°, and wherein a radially outer peripheral face of each auxiliary vane is slanted, tapering in an axially outward direction away from the inlet end side such that the axial extremity of the outer peripheral face of each respective auxiliary vane is at a relatively smaller diameter than the inlet end side.

* * * * *

UNITED STATES PATENT AND TRADEMARK OFFICE

CERTIFICATE OF CORRECTION

PATENT NO. : 8,210,816 B2
APPLICATION NO. : 11/908937
DATED : July 3, 2012
INVENTOR(S) : Siegfried Geldenhuys It is certified that error appears in the above-identified patent and that said Letters Patent is hereby corrected as shown below:

At column 1, line 32: change “about 120° and 1500,” to read --about 120° and 150°,--.
At column 4, line 4: change “end sides, wherein a leading faces of” to read --end side, wherein a leading face of--.
At column 4, line 5: change “auxiliary vanes is” to read --auxiliary vane is--.
At column 4, line 16: change “in claim 1, any in which” to read --in claim 1, in which--.
At column 4, line 17: change “edges of each” to read --edge of each--.
At column 4, line 20: change “edges of each auxiliary vanes is” to read --edge of each auxiliary vane is--.

Signed and Sealed this
Twenty-eighth Day of August, 2012

David J. Kappos

David J. Kappos
*Director of the United States Patent and Trademark Office*